US008851584B2

(12) United States Patent
Seo et al.

(10) Patent No.: US 8,851,584 B2
(45) Date of Patent: Oct. 7, 2014

(54) REFRIGERATOR

(71) Applicant: LG Electronics Inc., Seoul (KR)

(72) Inventors: Woonkyu Seo, Changwon-si (KR); Seonkyu Kim, Changwon-si (KR); Seungjin Yoon, Changwon-si (KR); Jungyeon Hwang, Changwon-si (KR); Daesung Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/670,662

(22) Filed: Nov. 7, 2012

(65) Prior Publication Data

US 2013/0119847 A1 May 16, 2013

(30) Foreign Application Priority Data

Nov. 14, 2011 (KR) ..... 10-2011-0118010

(51) Int. Cl.

| | |
|---|---|
| ***A47B 17/04*** | (2006.01) |
| ***A47B 96/04*** | (2006.01) |
| ***F25D 23/02*** | (2006.01) |
| ***F25D 27/00*** | (2006.01) |

(52) U.S. Cl.

CPC ..... *F25D 23/028* (2013.01); *F25D 23/02* (2013.01); *F25D 27/00* (2013.01)

USPC ..... 312/204; 312/405

(58) Field of Classification Search

CPC ..... F25D 23/028; F25D 23/02; F25D 27/00

USPC ..... 312/204, 405, 116; 428/46, 142; 52/788.1, 789.1

See application file for complete search history.

(56) References Cited

U.S. PATENT DOCUMENTS

| | | | | |
|---|---|---|---|---|
| 7,481,957 | B1 * | 1/2009 | Adickes | 264/261 |
| 2008/0024047 | A1 * | 1/2008 | Juo et al. | 312/405 |
| 2009/0126396 | A1 * | 5/2009 | Koo | 62/449 |
| 2009/0202796 | A1 * | 8/2009 | Koo et al. | 428/209 |
| 2010/0019639 | A1 * | 1/2010 | Son | 312/403 |
| 2010/0116005 | A1 * | 5/2010 | Jung et al. | 68/212 |
| 2010/0327721 | A1 * | 12/2010 | Pae | 312/405 |
| 2011/0089790 | A1 * | 4/2011 | Lee et al. | 312/109 |
| 2011/0126578 | A1 * | 6/2011 | Kim | 62/449 |
| 2013/0105435 | A1 * | 5/2013 | Yang et al. | 216/11 |

FOREIGN PATENT DOCUMENTS

| | | |
|---|---|---|
| KR | 10-2008-0091396 | 10/2008 |
| KR | 10-2011-0018635 | 2/2011 |

* cited by examiner

*Primary Examiner* — Darnell Jayne
*Assistant Examiner* — Timothy M Ayres
(74) *Attorney, Agent, or Firm* — KED & Associates, LLP

(57) ABSTRACT

A refrigerator is provided. The refrigerator may include a refrigerator body with a storage space defined therein, a door frame rotatably coupled to the refrigerator body to open and close the storage space, a transparent molded body coupled to a front surface of the door frame, and a glass panel coupled to a front of the transparent molded body. The transparent molded body may include a three-dimensional pattern formed on a surface thereof, and the glass panel may include a two-dimensional pattern having a gradation in at least one of brightness, saturation and hue.

14 Claims, 4 Drawing Sheets

REFRIGERATOR

CROSS-REFERENCE TO RELATED APPLICATION(S)

This application claims priority under 35 U.S.C. §119 to Korean Patent Application No. 10-2011-0118010, filed on Nov. 14, 2011, whose entire disclosure is hereby incorporated by reference.

BACKGROUND

1. Field

This relates to a refrigerator, and more particularly, to a refrigerator including a door having a patterned exterior appearance.

2. Background

A refrigerator may include a refrigerator body having a storage space that is opened at one side to provide access for items to be stored therein or to be removed therefrom. A refrigerator door may be coupled to the refrigerator body to open or close the opened side of the refrigerator body. The refrigerator door may rotate about hinges coupled between one lateral end of the refrigerator body and a corresponding lateral end of the door. The outer surface of the refrigerator door may be colored with a pigment such as paint, or may be coated with a metal material or a non-metallic material. The door may also define an overall exterior appearance of the front side of the refrigerator.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. Wherever possible, the same reference numbers will be used throughout the drawings to refer to the same or like parts, and a repeated description thereof will be omitted.

Figure 1:
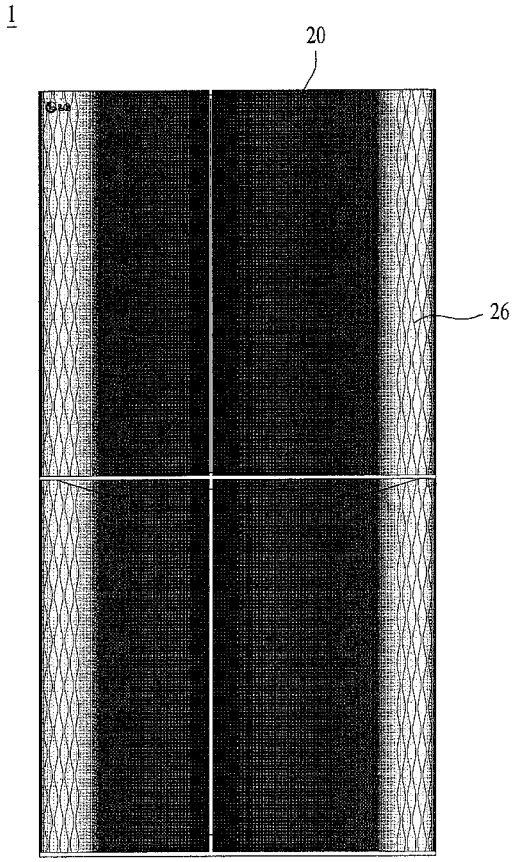
FIG. 1 is a front view of a refrigerator according to an exemplary embodiment as broadly described herein.

The exemplary refrigerator 1 shown in FIG. 1 includes a pair of doors 20 which are laterally arranged and may be opened or closed in opposite directions. However, features as embodied and broadly described herein may also be applied to a top mount-type refrigerator in which the inner space of the refrigerator is vertically partitioned to define a freezing compartment arranged above a refrigerating compartment, to a side-by-side type refrigerator in which the inner space of the refrigerator is laterally partitioned to define a freezing compartment and a refrigerating compartment such that the freezing compartment and refrigerating compartment are laterally arranged, as well as to a bottom freezer type refrigerator in which a freezing compartment is arranged below a refrigerating compartment, or to an integrated refrigerator including a single storage space, which is not divided into a refrigerating compartment and a freezing compartment.

Figure 5:
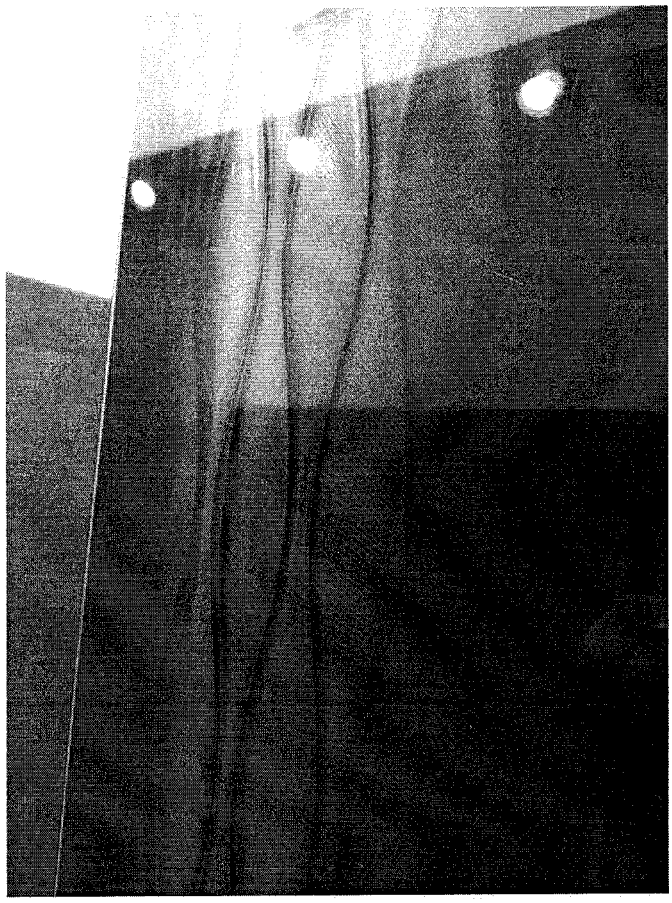
FIG. 5 is a photograph of a refrigerator door according to an embodiment as broadly described herein.

As shown in FIG. 1, a refrigerator as embodied and broadly described herein may include a three-dimensional pattern 26 that generates a corresponding visual effect when viewed from the exterior of the refrigerator. The shape, or appearance, of the three-dimensional pattern 26 when viewed from the front side of the refrigerator 1 (FIG. 1) and the shape, or appearance, of the three-dimensional pattern 26 when viewed from a lateral side of the refrigerator 1 may be different from each other. Since the three-dimensional pattern 26 may generate a different appearance or visual effect depending on a particular viewing direction, as shown in FIGS. 1 and 5, aesthetic appearance of the door 20 may be improved. To achieve this, the door 20 may include multiple layers.

Figure 2:
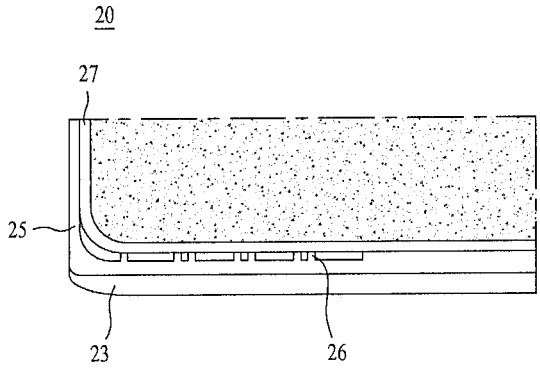
FIG. 2 is a top sectional view of a door of the refrigerator shown in FIG. 1.
Figure 4:
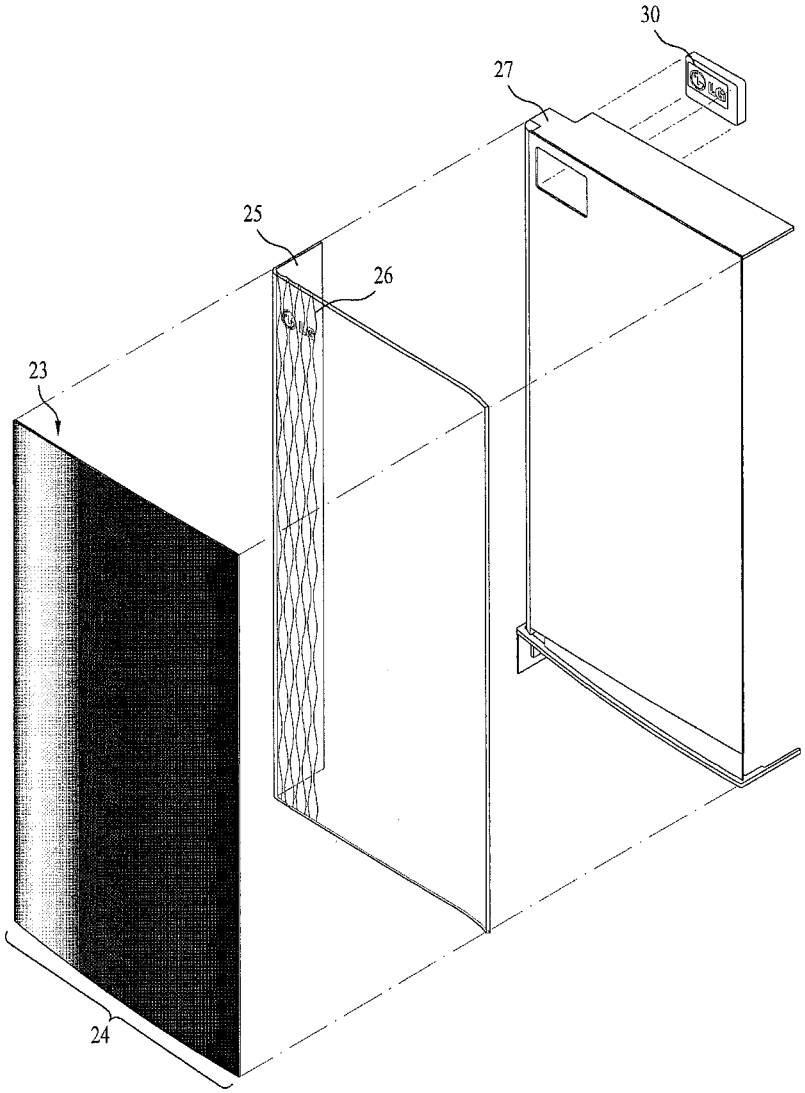
FIG. 4 is an exploded perspective view of a door of the refrigerator shown in FIG. 1, according to an embodiment as broadly described herein.

Referring to FIGS. 2 and 4, the door 20 may include a door frame 27, a transparent molded body 25 including the three-dimensional pattern 26, and a front glass 23. The door frame 27 may be rotatably coupled to a refrigerator body by hinges such that it opens and closes a storage space defined in the refrigerator body. The door frame 27 may provide thermal insulation to prevent cold air from leaving the storage space. The door frame 27 may also include a gasket or the like to form a seal between the storage space and the door frame 27 when the door 20 is closed.

The transparent molded body 25 may include the three-dimensional pattern 26 provided at a back surface of the transparent molded body 25. The three-dimensional pattern 26 may have, for example, a wave pattern as shown in FIGS. 1 and 4. The three-dimensional pattern 2*b* may also include various other patterns, including, for example, a geometrical pattern such as a triangular pattern or a circular pattern, a flower pattern, and other such patterns as appropriate. As shown in FIG. 2, the three-dimensional pattern 26 may be a wave pattern or a geometrical pattern that protrudes from the back surface of the transparent molded body 25 in an embossed, or carved manner which produce variations in thickness of the transparent molded body 25.

Such embossed carving may produce a door design having a cubic effect, because such a pattern may generate the appearance of different shapes corresponding to different viewing directions, for example, a front viewing direction versus a lateral viewing direction. Due to the variations in thickness of the body 25 produced by the carving to generate such a pattern 26, portions of the three-dimensional pattern 26 may be spaced apart from the door frame 27 to form spaces therebetween. In this case, shades/shadows generated by the spaces may provide a sensation of depth when viewed from the exterior of the refrigerator, thereby enhancing an outward appearance.

In particular, as shown in FIG. 2, in certain embodiments the transparent molded body 25 may be integrated with the door frame 27 such that it covers all of the front and side surfaces of the door frame 27, rather than a planar transparent molded body requiring a separate side cap to cover the side surfaces of the door frame 27. When the transparent molded body 25 covers the front and side surfaces of the door frame 27, a number of constituent elements of the door 20 may be reduced. Furthermore, the refrigerator may appear to have an enlarged size because the front and side surfaces of the door frame 27 are continuous, with no separate side decoration. Since the transparent molded body 25 is to be coupled to the front surface of the door frame 27, it may be molded using an appropriate molding method such that it has a shape corresponding to the shape of the front surface of the door frame 27.

The front glass 23 may be coupled to a front surface of the transparent molded body 25. The transparent molded body 25 may be made of an easily-moldable material, with the three-dimensional pattern 26 at the back surface thereof, and/or with a curved surface covering the side surfaces thereof. Accordingly, the transparent molded body 25 by itself may exhibit relatively low strength. Accordingly, the front glass 23, which may have relatively high strength, may reinforce the transparent molded body 25, and thus achieve an enhancement in durability.

The front glass 23 may include a two-dimensional pattern 24 provided on, for example, a back surface thereof. Accordingly, the front glass 23 may not only reinforce the transparent molded body 25, but may also provide enhanced aesthetics. The two-dimensional pattern 24 may be, for example, a two-dimensional image that is, for example, printed painted coated on the front glass 23. The two-dimensional pattern 24 may be formed by applying or printing pigment or paint on the back surface of the front glass 23.

In certain embodiments, the two-dimensional pattern 24 may include an opaque portion and a transparent portion. Through the transparent portion of the two-dimensional pattern 24, the three-dimensional pattern 26 positioned behind the two dimensional pattern 24 may be viewed.

In particular, as shown in FIGS. 1 and 4, the two-dimensional pattern 24 may have gradation in at least one of brightness, saturation or hue. With such a gradation exhibiting a gradual variation in brightness, saturation or hue, even the planar pattern 24 may provide a sensation of depth. That is, the planar pattern 24 may provide visual effects in that a brighter portion of the planar pattern 24 may provide a sensation of embossment, or a raised area, whereas a darker portion of the planer pattern 24 may provide a sensation of depression, or a recessed area.

When the front glass 23 including such a two-dimensional pattern 24 is provided, the three-dimensional pattern 26 may be formed only at portions of the transparent molded body 25 corresponding to the transparent portion of the front glass 23.

Figure 3:
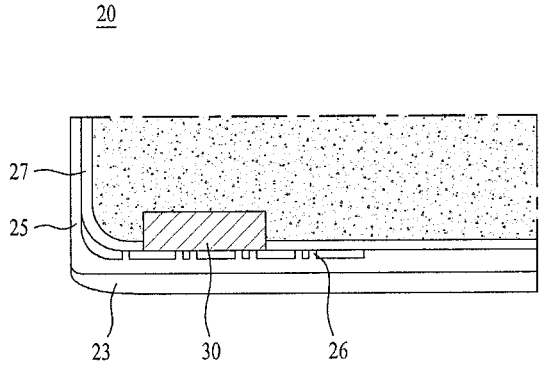
FIG. 3 is a sectional view of a door of the refrigerator shown in FIG. 1, at a point at which a light emitting diode (LED) lighting device is installed, in accordance with an embodiment as broadly described herein.

Referring to FIG. 3, in certain embodiments, the door 20 may include an LED lighting device 30. The LED lighting device 30 may display, for example, a logo of the manufacturer or seller of the refrigerator, the trademark of the refrigerator, or other figures, images, patterns and the like to enhance aesthetics of the front surface of the refrigerator. The LED lighting device 30 may selectively emit light, and may freely turn on or off. For example, the LED lighting device 30 may emit light only when the user opens the refrigerator door 20, or may emit light only in the evening, in particular, in the dark. Alternatively, the LED lighting device 30 may emit light at regular intervals to achieve mood lighting. Other arrangements for emission of light from the lighting device 30 may also be appropriate.

Light emitted from the LED lighting device 30 may be discharged through the transparent molded body 25 and front glass 23. In order to prevent light emitted from the LED lighting device 30 from being distorted, the three-dimensional pattern 26 may also include an LED pattern that corresponds to characters, figures, or other images to be displayed by the LED lighting device 30.

Also, in order to prevent light emitted from the LED lighting device 30 from being transmitted through the front glass 23 due to the opaque portion of the front glass 23, the LED lighting device 30 may be disposed at the transparent portion of the two-dimensional pattern 24.

In certain embodiments, one or more lighting devices 30 may be arranged so as to emit and disperse light along a relatively large portion of the door 20, to provide a backlight effect.

As may be understood from the above description, in a refrigerator as embodied and broadly described herein, an improved exterior design and aesthetic appearance of the door 20 may be achieved due to the three-dimensional pattern 26, and the two-dimensional pattern 24 having a gradation in at least one of brightness, saturation and hue.

A refrigerator with a door having with a three-dimensional pattern and/or a planar pattern is provided to provide an aesthetically pleasing exterior appearance.

A refrigerator as embodied and broadly described herein may include a refrigerator body with a storage space defined therein, a door frame pivotally coupled to the refrigerator body, to open or close the storage space, and a transparent molded body formed, at a back surface thereof, with a three-dimensional pattern, the back surface of the transparent molded body being coupled to a front surface of the door frame.

The three-dimensional pattern may include a wave pattern.

The refrigerator may also include a front glass formed, at a back surface thereof, with a two-dimensional pattern having a transparent portion and an opaque portion, the back surface of the front glass being coupled to a front surface of the transparent molded body.

The two-dimensional pattern may include a gradation in at least one of brightness, saturation and hue.

The three-dimensional pattern may be formed at the transparent portion of the two-dimensional pattern.

The transparent molded body may include a curved surface covering the front surface of the door frame and side surfaces of the door frame.

The refrigerator may also include a light emitting diode (LED) lighting device disposed on a rear surface of the transparent molded body, to display characters or a figure.

The three-dimensional pattern may include an LED pattern corresponding to the characters or figure to be displayed by the LED lighting device.

The refrigerator may also include a front glass formed, at a back surface thereof, with a two-dimensional pattern while being coupled to a front surface of the transparent molded body. The two-dimensional pattern may be transparent at a portion thereof corresponding to the LED lighting device.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a body having a storage space defined therein;

a door frame rotatably coupled to the body to open and close the storage space;

a transparent molded body coupled to a front surface of the door frame, the transparent molded body including a three-dimensional pattern on a rear surface thereof; and a front glass coupled to a front surface of the transparent molded body, the front glass including a two-dimensional pattern on a rear surface thereof, the two-dimensional pattern including at least one transparent portion and at least one opaque portion, wherein the three-dimensional pattern comprises a contour formed on the rear surface of the transparent molded body that is formed by variations in thickness of the transparent molded body, and wherein the two-dimensional pattern is coated, printed or painted on the rear surface of the front glass and comprises a gradation in at least one of brightness, saturation or hue.

2. The refrigerator of claim 1, wherein the front surface of the transparent molded body is smooth.

3. The refrigerator of claim 2, wherein a distance between the rear surface of the transparent molded body and the front surface of the door frame varies along the three-dimensional pattern, and a distance between the front surface of the transparent molded body and the front surface of the door frame is substantially uniform.

4. The refrigerator of claim 1, wherein the three-dimensional pattern is positioned corresponding to the at least one transparent portion of the two-dimensional pattern.

5. The refrigerator of claim 4, wherein a transparent portion of the at least one transparent portion of the two-dimensional pattern formed on the rear surface of the front glass facing the front surface of the transparent molded body is positioned corresponding to the LED lighting device.

6. The refrigerator of claim 1, wherein the front surface of the transparent molded body comprises a curved surface extending continuously across the front surface of the door frame and side surfaces of the door frame.

7. The refrigerator of claim 1, further comprising:

a light emitting diode (LED) lighting device provided on a rear surface of the transparent molded body, the LED lighting device illuminating a corresponding portion of the transparent molded body and the front glass.

8. The refrigerator of claim 7, wherein the three-dimensional pattern comprises an LED pattern corresponding to a plurality of characters or a figure to be illuminated by the LED lighting device and displayed at a front surface of the front glass.

9. A door for a refrigerator, comprising:

a door frame configured to be rotatably coupled to a main body of a refrigerator;

a transparent molded body coupled to a front of the door frame, wherein a thickness of the transparent molded body varies in predetermined portions thereof so as to foiiu a contoured portion; and a glass panel coupled to a front of the transparent molded body, the glass panel including at least one transparent portion and at least one opaque portion, the at least one transparent portion being positioned corresponding to the contoured portion formed on the transparent molded body, wherein the contoured portion is formed along a rear surface of the transparent molded body, facing the front of the door frame, wherein the at least one transparent portion and at least one opaque portion comprise a plurality of transparent portions and a plurality of opaque portions that are coated or printed on a rear surface of the glass panel facing the front of the transparent molded body, and wherein the plurality of transparent portions and plurality of opaque portions on the rear surface of the front glass comprise a gradation in at least one of brightness, saturation or hue.

10. The door for a refrigerator of claim 9, wherein a distance between the rear surface of the transparent molded body and the front of the door frame varies, and a front surface of the transparent molded body is smooth such that a distance between the front surface of the transparent molded body and the front of the door frame is substantially uniform.

11. The door for a refrigerator of claim 9, further comprising a lighting device provided on a rear surface of the transparent molded body, the lighting device illuminating the contour portion of the transparent molded body and the corresponding transparent portion of the glass panel.

12. The door for a refrigerator of claim 11, wherein the lighting device comprises one or more light emitting diodes.

13. The door for a refrigerator of claim 9, wherein the front of the transparent molded body comprises a curved surface extending continuously across the front surface of the door frame and side surfaces of the door frame.

14. A refrigerator comprising the door of claim 9.

* * * * *